United States Patent [19]

Dove

[11] 4,398,355

[45] * Aug. 16, 1983

[54] STEAM DISTRIBUTION APPARATUS

[76] Inventor: Norman F. Dove, 3187 Hoskins Rd., North Vancouver, British Columbia, Canada, 3TJ 3B5

[ * ] Notice: The portion of the term of this patent subsequent to May 26, 1998, has been disclaimed.

[21] Appl. No.: 238,249

[22] Filed: Feb. 25, 1981

[51] Int. Cl.[3] ..... D21F 5/00

[52] U.S. Cl. ..... 34/54; 34/155; 34/160; 162/290; 162/359; 239/553.3; 239/568

[58] Field of Search ..... 34/155, 156, 160, 54; 162/290, 375, DIG. 6, 207, 359; 239/557, 601, 125, 553.3, 568

[56] References Cited

U.S. PATENT DOCUMENTS 4,253,247 3/1981 Bergstrom ..... 34/155

4,268,976 5/1981 Dove ..... 34/155

*Primary Examiner*—Larry I. Schwartz

*Attorney, Agent, or Firm*—Spensley, Horn, Jubas & Lubitz

[57] ABSTRACT

A steam distribution apparatus has a first header having an inlet for steam and a plurality of discrete outlets for steam arranged along the header. The outlets increase in size with distance from the inlet. A first chamber surrounds the first header to receive steam from the outlets in the first header. There are first, relatively large outlets in the first chamber. The relative positions of the first header and the first chamber ensure that steam leaving the plurality of outlets in the first header impinges on the interior of the chamber and must travel around the chamber to reach the first outlets in the first chamber. A second chamber communicates with the first outlets from the first chamber. There are outlets in the second chamber. A shrouding is positionable above a paper web and communicates with the elongate outlets in said second chamber. The apparatus permits uniform steam flow along the entire length of the distributor.

1 Claim, 8 Drawing Figures

STEAM DISTRIBUTION APPARATUS

CROSS REFERENCE TO RELATED APPLICATION

This application is a continuation-in-part of my application Ser. No. 171,482 filed July 23, 1980, now U.S. Pat. No. 4,268,976 which was a continuation-in-part of my application Ser. No. 924,639 filed July 14, 1978, now abandoned.

FIELD OF THE INVENTION

This invention relates to a steam distribution apparatus particularly useful in paper making.

DESCRIPTION OF THE PRIOR ART

During the paper making process it is frequently necessary to provide steam along a relatively long distance, for example the application of steam in the press section of pulp and paper making machines. It is clearly desirable to provide a uniform source of steam across the relatively great width of the web but, previously, the provision of such a uniform source has been difficult.

SUMMARY OF THE INVENTION

The present invention seeks to provide a steam distribution apparatus in which uniform steam flow along the entire length of the apparatus and thus across the whole width of a paper web can be achieved.

Accordingly, in a preferred aspect, the present invention is a steam distribution apparatus comprising a header having means defining an inlet for steam and means defining a first plurality of discrete outlets for steam arranged along the header, the outlets increasing in size with distance from the inlet; means defining a first chamber surrounding the header to receive steam from the outlets in said header; means defining first, relatively large outlets in said first chamber; the relative positions of the header and the first chamber ensuring that, in use, steam leaving said plurality of outlets in the header impinges on the interior of the chamber and must travel around the chamber to reach the first outlets in the first chamber, the exterior of the header being relatively close to that part of the first chamber containing the first outlets so as to form a restricted zone immediately before said outlets to assist in obtaining uniform steam pressure along the length of the steam distribution apparatus; means for defining a second chamber communicating with said first outlets from the first chamber; means defining outlets in said second chamber and a shrouding positionable above a paper web and communicating with said outlets in said second chamber whereby, in use, uniform steam flow along the entire length of the steam distribution apparatus can be achieved.

Preferably there are second, relatively small outlets in said first chamber communicating with the shrouding. These permit steam to be directed downwardly at the leading edge of the distribution apparatus to contact a web moving beneath the apparatus and to prevent air being drawn into the shrouding by the moving web. The leading edge of the apparatus is the edge under which the web passes first as it enters the shrouding.

The exterior of the first header is relatively close to that part of the first chamber containing the first outlets. A baffle can, in one embodiment, extend from the exterior of said header to adjacent the outlet to assist in forming the restricted zone immediately before the outlets.

In a further aspect the second chamber is divided into a plurality of compartments. There are a plurality of pipes, generally one to each compartment. Each pipe has an inlet communicating with the first chamber and an outlet communicating with one of the above compartments. Each pipe includes a valve to regulate steam flow through the pipe. Such an arrangement permits control of steam flow across a web, a procedure known in the art as profiling.

It is desirable that there be an insulating jacket extending around the apparatus.

The outlets in the second chamber may be in the form of one or more continuous slots or they may be slots arranged in two discrete rows with a plurality of discrete slots in each row. The outlets may also be holes arranged in rows. The outlets in each row should be staggered relative to the outlets in the other row.

BRIEF DESCRIPTION OF DRAWINGS

Aspects of the invention are illustrated, merely by way of example, in the accompanying drawings in which.

DESCRIPTION OF THE PREFERRED EMBODIMENTS

The drawings illustrate a steam distribution apparatus comprising a first header 2 having an inlet 4 for steam and a plurality of discrete outlets 6 for steam. These outlets 6 generally increase in size with distance from the inlet 4. It is generally convenient that they proceed in a plurality of steps. That is the outlets may be arranged in groups, the group nearest the inlet 4 having one diameter, a second group having a larger diameter and so on through the outlets 6 most remote from the steam inlet 4, which have the greatest diameter.

Figure 1:
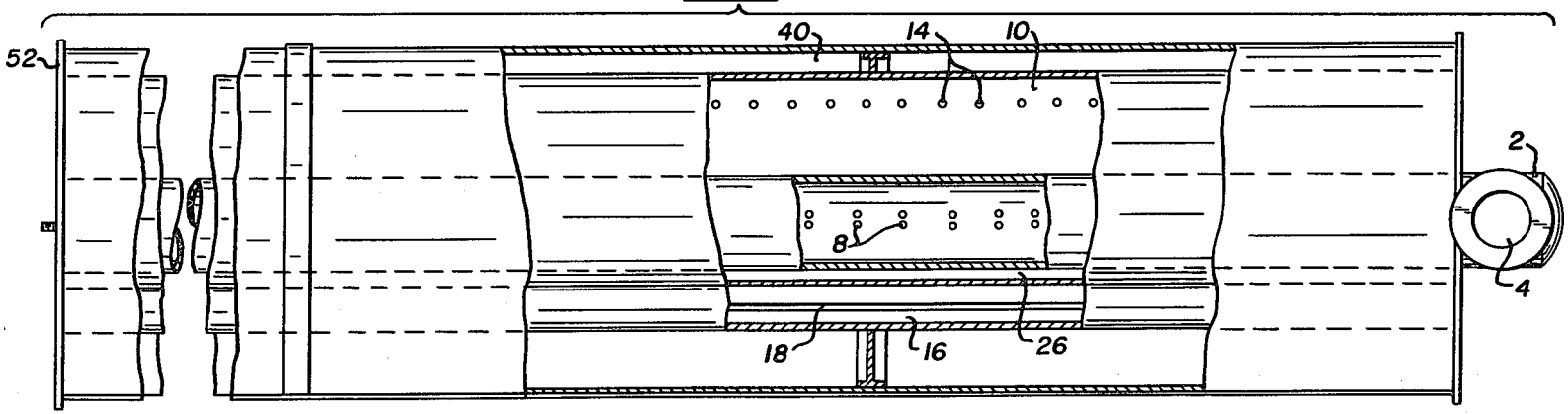
FIG. 1 is a plan view of an apparatus according to the present invention.
Figure 2:
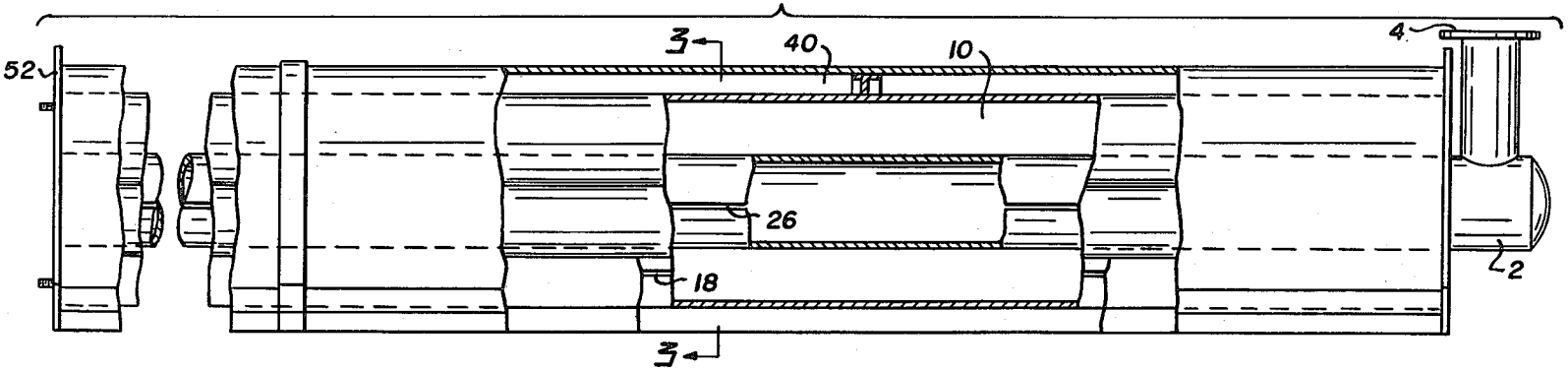
FIG. 2 is an elevation of the apparatus of FIG. 1.
Figure 3:
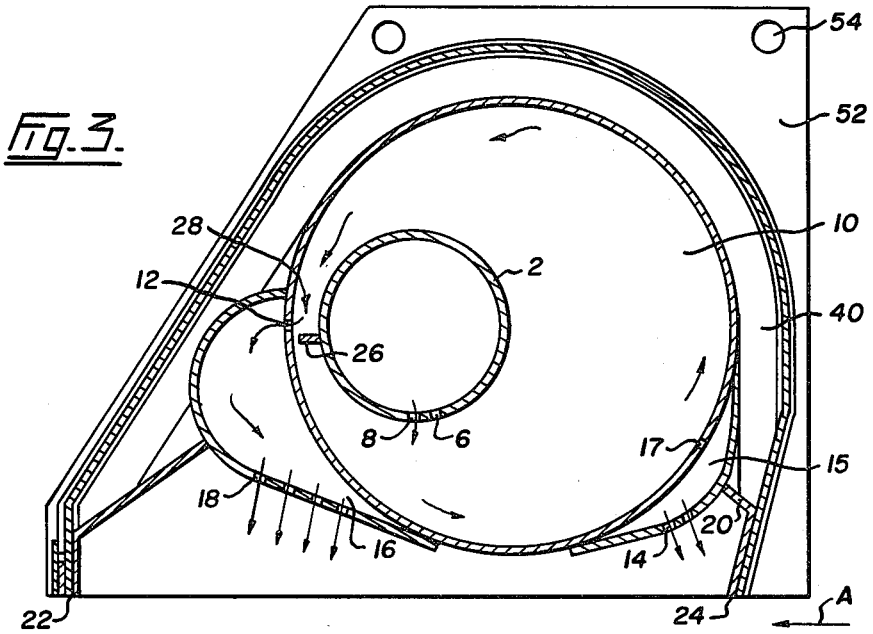
FIG. 3 is a section along the line 3—3 in FIG. 2.

In the embodiment illustrated in FIGS. 1 to 3 there is a second plurality of discrete steam outlets 8 of uniform size along the first header 2, adjacent the first plurality of outlets 6. However, this second set of uniform, discrete outlets 8 is not essential to the invention.

There is a first chamber 10 surrounding the first header 2 to receive steam from the outlets 6 in said first header 2. First, relatively large outlets 12 (see FIG. 3) and second, relatively small outlets 17 are positioned in said first chamber 10. The outlets 17 are positioned in a small compartment 15 added to the exterior of the first chamber 10. Openings 17 permit access between first chamber 10 and compartment 15. The compartment 15 tends to create a uniform steam flow from outlets 14.

Outlets 14 operate to provide a steam curtain to prevent air being drawn in by the belt or web moving below the distribution apparatus in the direction of the arrow A. The arrangement is described and claimed in my copending application which is a continuation-in-part of my application Ser. No. 144,303, filed Apr. 28, 1980, now abandoned, which was a continuation of my application Ser. No. 924,399, filed July 14, 1978 now abandoned; the disclosure of the copending application is incorporated by reference.

As most clearly shown in FIG. 3, the relative positions of the first header 2 and the first chamber 10 are such as to ensure that in use steam leaving said plurality of outlets 6 in the first header 2 impinges on the interior of the first chamber 10 and must travel around the chamber 10 to reach the first outlets 12 in the first chamber 10. The direction of flow of steam is shown in FIG. 3 by arrows. The flow starts at the first header 2.

Figure 5A:
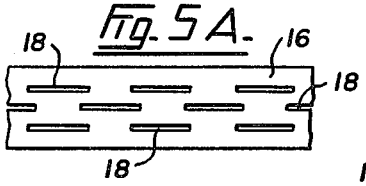
FIG. 5A is a detail section of the outlets in FIG. 4.
Figure 5B:
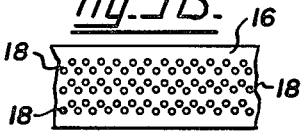
FIGS. 5B and 5C illustrate variations in the outlets pattern.
Figure 5C:
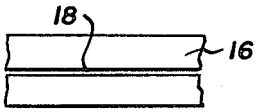

There is a second chamber 16 communicating with the first chamber 10 near the first outlets 12 in the first chamber 10. Thus steam leaves the first header 2 passes around the interior of the first chamber 10, out through the outlets 12 into the second chamber 16. There are outlets 18 in the second chamber 16. The outlets 18 may comprise a single slot extending the length of the second chamber 16 (FIG. 5C) or may be of the pattern shown in FIG. 5A, that is slots arranged in rows, the elongate outlets in each row being staggered relative to the elongate outlets in the other row, or may be circular holes arranged on isometric centres, for example, as shown in FIG. 5B.

There is a shrouding 20 into which steam from the second chamber 16 passes from the outlets 18. Shrouding 20 forms a heating zone in which the steam is directed onto a paper web when the steam distribution apparatus is in use. Steam also passes directly from the first chamber 10 through the second, relatively small outlets 17 to the chamber 15 and through outlets 14 to the shrouding 20. Thus there is a uniform steam distribution at the leading edge 22 and the trailing edge 24 of the steam distribution apparatus-see FIGS. 3 and 4.

FIG. 3 illustrates an embodiment of the invention in which the first header 2 is positioned relatively close to that part of the first chamber 10 containing the first outlets 12. There is a baffle 26 extending from the exterior of the header 2 to adjacent and just below the outlets 12. The effect of both the positioning of the first header 2 relatively close to the wall of the first chamber 10 and the positioning of the baffle 26 creates a restricted zone generally indicated at 28 immediately before the outlets 12 and this smooths out steam pressure differences in the cross-machine direction to produce uniform steam flow from the first chamber 10 to the second chamber 16.

Figure 4:
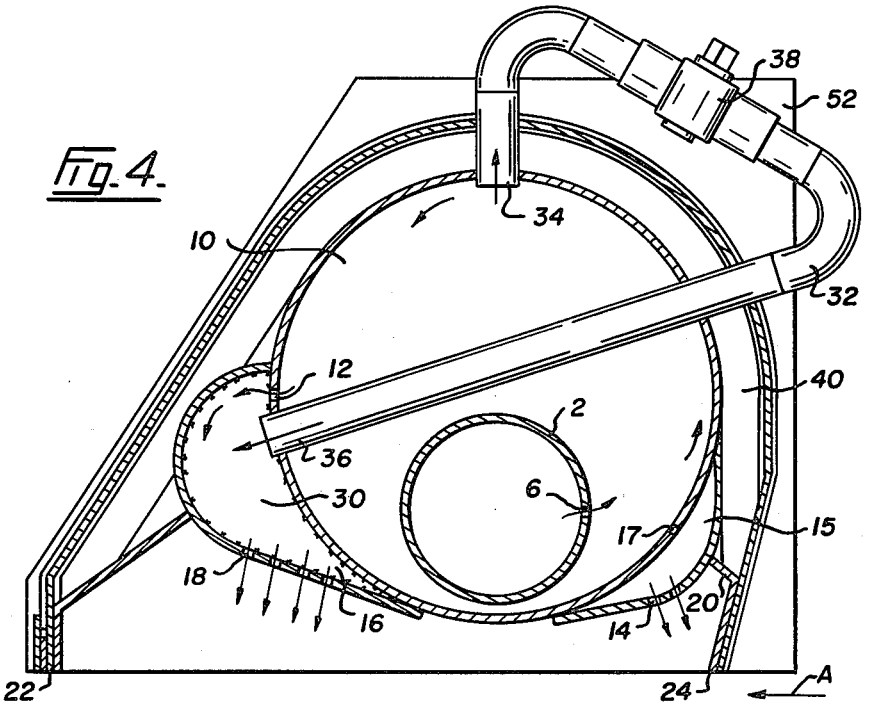
FIG. 4 is a view similar to that of FIG. 3 but illustrating a modification of the invention.

In the embodiment illustrated in FIG. 4 the second chamber 16 is divided into compartments by walls 30, one of which is shown in FIG. 4. There are a plurality of pipes 32 each having an inlet 34 communicating with said first chamber 10 and an outlet 36 communicating with one of said compartments of said second chamber 16. Each pipe 32 extends outwardly from the first chamber 10 and then returns to a compartment in the second chamber 16 through an outlet 36. There is a valve 38 in each pipe 32 adjustable to regulate steam flow through the pipe.

Figure 6:
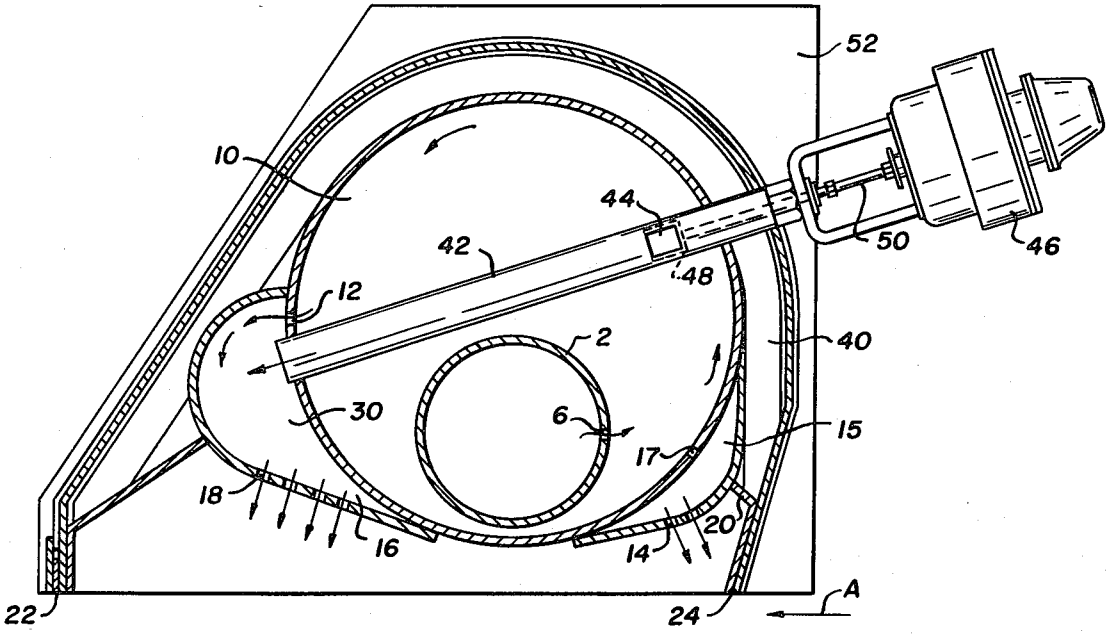
FIG. 6 is a section through a further modification of the invention.

FIG. 6 shows a variation of the arrangement of FIG. 4. Pipes 36 in FIG. 4 are replaced by pipes 42 each having an inlet 44 that replaces inlet 34 of FIG. 4. A steam regulating valve comprises an actuator 46 attached to a supply of compressed air, available in any mill. The actuator 46 is connected to a piston 48 by a connecting rod 50 to regulate inlet 44 in pipe 42 and thus regulate steam flow between the first chamber 10 and each compartment of second chamber 16. When steam pressure in first chamber 10 is changed then, for example, piston 48 may be moved to reestablish the required flow from first chamber 10 to each compartment of second chamber 16. The actuators 46 can all be set at the same degree of opening or, if necessary, can be varied so that a differing amount of steam is supplied to each compartment across the sheet width.

In FIGS. 3, 4 and 6 the apparatus is provided with an insulating jacket 40 that extends around the apparatus to minimize heat losses.

The apparatus of the present invention has end plates 52 having holes 54—see particularly FIG. 3—to provide a means of lifting the unit. It is mounted by brackets (not shown).

The steam distribution apparatus of the present invention provides a uniform source of steam across a relatively long length for, for example, application in the press sections of pulp and paper making machines. The invention ensures uniform pressure across the entire length of the steam distribution apparatus so that there is a uniform source of steam discharging from the unit across its entire length for all variations in steam flow rates. For example the unit is effective for a steam turn down ratio of at least 5 to 1.

The units of FIGS. 4 and 6 permit incremental moisture profile control. In FIG. 4 this profiling is done by tapping steam from the top of the first chamber 10 and by controlling the flow of the tapped steam by the valve 38. The separation of the second chamber 16 into separate compartments means that incremental flow can be established. Furthermore, by passing the profiling pipes 32 through the first chamber 10 any condensate contained in the steam will tend to evaporate. The profiling with the FIG. 6 unit is described above.

A further advantage of the steam distribution apparatus is compact installation.

Dimensions of the apparatus may be varied within limits easily ascertainable by calculation.

I claim:

1. A steam distribution apparatus comprising:

a header having means defining an inlet for steam and means defining a first plurality of discrete outlets for steam arranged along the header, the outlets increasing in size with distance from the inlet;

means defining a first chamber surrounding the header to receive steam from the outlets in said header;

means defining first, relatively large outlets in said first chamber;

the relative positions of the header and the first chamber ensuring that, in use, steam leaving said plurality of outlets in the header impinges on the interior of the first chamber and must travel around the first chamber to reach the first outlets in the first chamber;

means defining a second chamber communicating with said first outlets from the first chamber, said second chamber being divided into compartments;

a plurality of pipes each having an inlet communicating with said first chamber and an outlet communicating with a compartment in said second chamber;

a pressure responsive valve actuator associated with each pipe;

a piston attached to each actuator to the pipe outlet at each compartment whereby control of the steam supply from said first chamber to each compartment can be achieved, and thus of steam supply from each compartment;

means defining outlets in said second chamber; and a shrouding positionable above a paper web and communicating with said elongate outlets in said second chamber whereby in use, controlled steam flow along the entire length of the steam distribution apparatus can be achieved.

* * * * *